United States Patent [19]

Jahn

[11] 4,072,617

[45] Feb. 7, 1978

[54] FINISH FOR ACRYLIC FIBER

[75] Inventor: Alex K. Jahn, Williamsburg, Va.

[73] Assignee: Dow Badische Company, Williamsburg, Va.

[21] Appl. No.: 676,278

[22] Filed: Apr. 12, 1976

[51] Int. Cl.[2] ..... D06M 13/26

[52] U.S. Cl. ..... 252/8.9; 252/8.6; 252/8.8

[58] Field of Search ..... 252/8.9, 8.8 R, 8.6

[56] References Cited

U.S. PATENT DOCUMENTS

| | | | |
|---|---|---|---|
| 2,742,379 | 4/1956 | Schofield | 252/8.8 R |
| 3,306,850 | 2/1967 | Olsen | 252/8.9 |
| 3,341,451 | 9/1967 | Dziuba et al. | 252/8.9 |
| 3,639,235 | 2/1972 | Karg | 252/8.9 |

*Primary Examiner*—William E. Schulz
*Attorney, Agent, or Firm*—George F. Helfrich

[57] ABSTRACT

A finish for acrylic fiber consists essentially of:

(A) an ethoxylated alkyl phenol;

(B) a neutralized partial ester of phosphoric acid and an aliphatic monohydric alcohol; and (C) a mixture consisting essentially of
(1) mineral oil;
(2) an ethoxylated aliphatic monohydric alcohol; and
(3) a neutralized partial ester of phosphoric acid and an ethoxylated aliphatic monohydric alcohol.

8 Claims, No Drawings

FINISH FOR ACRYLIC FIBER

BACKGROUND OF THE INVENTION

1. Field of the Invention

The present invention relates generally to the lubricating and conditioning of textile fibers.

It relates particularly to a finish for acrylic fibers which affords efficient handling and processing thereof.

2. Prior Art

Finishes are universally applied to fiber surfaces to improve the subsequent handling and processing of the fibers. The composition and amount of finish applied depend in large measure upon the nature — i.e., the chemical composition — of the fiber, the particular stage in the processing of the fiber, and the end use in view.

For example, compositions denominated "spin finishes" are applied to acrylic fiber tows usually after stretching thereof and frequently prior to subsequent processing thereof including crimping, drying, cutting into staple lengths, carding, drawing, roving, and spinning. Such finishes provide lubrication, prevent static build-up, and afford a slight cohesion between adjacent fibers.

The application of such finishes is generally accomplished by contacting an acrylic fiber tow or yarn with a solution or an emulsion comprising at least one lubricant with antistatic properties. Wetting agents, as well as emulsifiers are also commonly found in such finish mixtures. Finish can also be applied to tow, yarn, or cut staple by spraying.

Acceptable finishes must fulfill a number of requirements in addition to providing a desired lubricating and antistatic effects. For example, they should be easy to apply (and to remove if desired), they should have good thermal and chemical stability, they should not adversely affect the physical or chemical properties of the fibers to which they are applied, and they should aid the subsequent processes to which the treated fibers are subjected.

Of the many compositions which have been proposed as fiber finishes, including finishes for acrylic fibers, some of the more noteworthy are found in the following: U.S. Pat. Nos. 3,306,850; 3,341,451; 3,341,452; 3,357,919; 3,421,935; 3,549,530 and 3,888,775; British Patent No. 1,053,403; as well as U.S. Pat. No. 3,894,314. Notwithstanding the efficacy of these and many similar compositions, finishes are often found wanting in certain important aspects, viz., their employment ordinarily results in one or a combination of the following undesirable conditions: (a) physical properties unacceptable for satisfactory fiber processing under a wide range of conditions; (b) heavy dust and card fallout; (c) substantial deposits on rolls and metal parts of drawing, roving, and spinning, equipment, and (d) non-uniformity in the drawing of the sliver, as evidenced by the presence of thick and thin regions therein which are subsequently found in yarn spun therefrom.

SUMMARY OF THE INVENTION

As a consequence, it is the primary object of the present invention to provide a novel fiber finish — especially a novel finish for acrylic fibers — which affords the efficient handling and processing thereof, effectively eliminating such difficulties and problems as: (a) physical properties unacceptable for satisfactory fiber processing under a wide range of conditions; and under most conditions (b) dust and card fallout, (c) deposits on rolls and metal parts of drawing, roving, and spinning equipment; and (d) non-uniformity in the drawing of sliver. A related object is the provision of acrylic fibers which are efficiently handled and readily processed and do not present the processing and handling problems characteristic of prior art fibers.

These and other related objects are achieved, and the disadvantages of the prior art are obviated by the provision of:

I. A finish for acrylic fiber consisting essentially of:

(A) an alkyl phenol which has been ethoxylated with from about 40 to about 200 moles of ethylene oxide;

(B) the neutralized reaction product of (1) about 3 moles of an aliphatic monohydric alcohol having from 14 to 22 carbons, and (2) about 1 mole of $P_2O_5$; and (C) a mixture consisting essentially of (1) about 60 to 80 percent by weight of mineral oil having a viscosity of between about 50 and 150 Saybolt Universal Seconds at 100° F;

(2) about 15 to 10 percent by weight of an aliphatic monohydric alcohol having 10 to 18 carbons, which has been ethoxylated with about 2 to 4 moles of ethylene oxide; and (3) about 15 to 10 percent by weight of the nautralized reaction product of (a) about 3 moles of an aliphatic monohydric alcohol having from 8 to 14 carbons, which has been ethoxylated with about 2 to 9 moles of ethylene oxide, and (b) about 1 mole of $P_2O_5$;

wherein the amount of component (C) is between about 5 and 70 percent by weight of the composition with the remainder thereof being a composite of components (A) and (B) in a weight ratio of component (A) to component (B) of between about 5/95 and 60/40.

Especially advantageous results are achieved when component (A) of this finish is a dialkyl phenol (e.g., dinonyl phenol) which has been ethoxylated with between 125 and 175 (e.g., 150) moles of ethylene oxide.

Especially advantageous results are also achieved when component (B) of this finish is an amine (e.g., diethanolamine) salt of hydrogenated tallow alcohol phosphate.

Especially advantageous results are also achieved when component (C) of this finish is a mixture consisting essentially of (1) a mineral oil having a viscosity of about 50 – 100 SUS at 100° F;

(2) an aliphatic monohydric alcohol having from 12 to 15 carbons, which has been ethoxylated with between 3 and 4 moles of ethylene oxide; and (3) the amine-neutralized (e.g., morpholine-neutralized) reaction product of (a) about 3 moles of an aliphatic monohydric alcohol having from 10 – 14 carbons, which has been ethoxylated with about 4 to 6 moles of ethylene oxide, and (b) about 1 mole of $P_2O_5$.

The primary and related objects of the present invention are also achieved, and the disadvantages of the prior art are also obviated by the provision of:

II. Acrylic fiber having incorporated thereon from about 0.2 to about 1.4 percent by weight of a finish consisting essentially of:

(A) an alkyl phenol which has been ethoxylated with from about 40 to about 200 moles of ethylene oxide;

(B) the neutralized reaction product of (1) about 3 moles of an aliphatic monohydric alcohol having from 14 to 22 carbons, and (2) about 1 mole of $P_2O_5$; and (C) a mixture consisting essentially of (1) about 60 to 80 percent by weight of mineral oil having a viscosity of between about 50 and 150 SUS at 100° F;

(2) about 25 to 10 percent by weight of an aliphatic monohydric alcohol having 10 to 18 carbons, which has been ethoxylated with about 2 to 4 moles of ethylene oxide; and (3) about 15 to 10 percent by weight of the neutralized reaction product of (a) about 3 moles of an aliphatic monohydric alcohol having from 8 to 14 carbons, which has been ethoxylated with about 2 to 9 moles of ethylene oxide, and (a) about 1 mole of $P_2O_5$;

wherein the amount of component (C) is between about 5 and 70 percent by weight of the composition with the remainder thereof being a composite of components (A) and (B) in a weight ratio of component (A) to component (B) of between about 5/95 and 60/40.

Especially advantageous results are achieved when component (A) of the finish incorporated on the fiber is a dialkyl phenol (e.g., dinonyl phenol) which has been ethoxylated with between 125 and 175 (e.g., 150) moles of ethylene oxide.

Especially advantageous results are also achieved when component (B) of the finish incorporated on the fiber is an amine (e.g., diethanolamine) salt of hydrogenated tallow alcohol phosphate.

Especially advantageous results are also achieved when component (C) of the finish incorporated on the fiber is a mixture consisting essentially of (1) a mineral oil having a viscosity of about 50 – 100 SUS at 100° F;

(2) an aliphatic monohydric alcohol having from 12 to 15 carbons, which has been ethoxylated with between 3 and 4 moles of ethylene oxide; and (3) the amine-neutralized (e.g., morpholine-neutralized) reaction product of (a) about 3 moles of an aliphatic monohydric alcohol having from 10 – 14 carbons, which has been ethoxylated with about 4 to 6 moles of ethylene oxide, and (b) about 1 mole of $P_2O_5$.

DETAILED DESCRIPTION OF THE PREFERRED EMBODIMENTS

For a more complete understanding of the present invention, reference should be made to the following detailed description of the preferred embodiments thereof.

The finish of the present invention is applied to acrylic fiber, i.e., fiber formed from various acrylonitrile polymers and blends thereof, including poly(acrylonitrile), and interpolymers containing at least about 85 weight percent of acrylonitrile and up to about 15 percent of other polymerizable mono-olefinic monomers, and mixtures thereof such as: vinyl acetate; methyl methacrylate and other alkyl esters of methacrylic acid; methyl acrylate, ethyl acrylate, and other alkyl esters of acrylic acid; vinyl bromide; monomers having an affinity for acid dyestuffs, particularly those containing a tertiary or quarternary nitrogen in the molecule, such as vinyl pyridine or methyl vinyl pyridine; monomers having an affinity for basic dyestuffs, particularly those containing a sulfonic or carboxylic acid group, such as alkylene sulfonic acid, itaconic acid, among many others.

Various known methods may be employed to produce the acrylonitrile polymers for use in the preparation of the acrylic fibers, to which the finish of the present invention is applied. Although the monomer or comonomer mixture may be polymerized employing suspension, emulsion or solution polymerization techniques, suspension procedures are the most widely used commercially. Herein the monomer(s), in the form of small globules dispersed by agitation throughout an aqueous solution of a catalyst, and partially in solution are polymerizared at suitable temperatures. Commonly employed catalysts are water-soluble compounds such as hydrogen peroxide, per salts such as ammonium or alkali metal persulfates, and redox catalysts such as persulfate and bisulfite, at a concentration ranging from about 0.1 to 5 percent of the total monomer(s) present. The monomer suspension containing the polymerization catalyst is held at a temperature between about 30° and 70° C to form the polymer, which is insoluble in the aqueous medium in which the polymerization proceeds. The solid polymer is filtered from the aqueous reaction medium and washed to remove any impurities present. A practical procedure for such a polymerization is found in U.S. Pat. No. 2,847,405.

Preparation of the acrylic fibers from the solid acrylonitrile polymers is accomplished by various methods known in the art, the most common of which employ the wet spinning technique. Herein a solution of the polymer (in a suitable organic or inorganic solvent) is first de-gassed and filtered, after which it is "spun" or extruded through multiple-holed jets into a coagulating bath, where the polymer is precipitated. The filaments so produced are washed (generally countercurrently with water) to remove the spinning solvent, and are then stretched and finally dried. Examples of the wet spinning of acrylic fibers from the solutions of acrylonitrile polymers in inorganic solvents are found in U.S. Pat. No. 2,916,348 and 2,558,730; the employment of organic solvents is shown in Knudsen, *Textile Research Journal* 33, 13–20 (1963).

The stretching referred to above, which serves to improve the physical properties of the fibers (especially their tensile strength and toughness) by orienting the molecules of which they are composed, is usually carried out at elevated temperatures, for example, between about 40° and 100° C. The actual degree of stretch is dependent upon the chemical composition, previous processing, and desired ultimate physical properties of the fibers. A six to 10-fold increase in length is not at all uncommon. This stretching may be accomplished in a single stage or distributed between multiple stages.

The finish of the present invention is advantageously applied to acrylic fiber tow after stretching thereof, either before or after drying thereof, and prior to the subsequent processing steps of crimping, cutting into staple lengths, carding, drawing, roving, and spinning. This finish provides lubrication, prevents static buildup, and affords a slight cohesion between adjacent fibers, thereby significantly aiding the subsequent processes to which the treated fibers are subjected. As is understood by those of skill in the art, the finish may be applied to acrylic fibers at any stage in the processing thereof subsequent to stretching, with beneficial results.

The finish of the present invention may be applied in its pure form, or more advantageously, by means of an emulsion, which may be aqueous — as hereinbelow specified in detail in Example 1 — or organic, or a solution such as in isopropyl alcohol. The finish is applied by any standard means well known in the art, which is chosen in view of the particular stage in the processing of the fiber. For example, standard spraying (or overspraying) means are commonly employed with very beneficial results in many instances.

Three essential components make up the finish of the present invention. These components coact to provide the excellent frictional, antistatic, and cohesive properties of the acrylic fiber, as well as the reduction of dust and card fallout, the elimination of deposits on processing equipment, and the enhancement in the uniformity of drawn sliver, as hereinbefore set forth. The components must be present in the finish composition in amounts within defined ranges, as set forth below, in order that the desired coaction take place. Departures from this requirement will result in the diminution of one or more desired properties of the acrylic fiber and/or one or more desired processing and handling advantages.

Component A — an alkyl phenol which has been ethoxylated with from about 40 to about 200 moles of ethylene oxide. Examples of such compounds are those prepared according to standard techniques of synthetic organic chemistry by reacting an alkyl phenol with ethylene oxide. The very best results are achieved when the alkyl phenol is a dialkyl phenol such as dinonyl phenol, which has been ethoxylated with between 125 and 175, e.g., 150, moles of ethylene oxide. Such compounds are available from commercial sources.

Component B — the neutralized reaction product of about 3 moles of an aliphatic monohydric alcohol having from 14 to 22 carbons and about 1 mole of $P_2O_5$. Examples of such compounds are those prepared according to standard techniques of synthetic organic chemistry by reacting an aliphatic monohydric alcohol with $P_2O_5$ and neutralizing the resulting ester. The very best results are achieved when the aliphatic monohydric alcohol is an alcohol such as hydrogenated tallow alcohol and the resulting ester is brought to neutrality with an amine such as diethanolamine or triethanolamine. Such compounds are commercially available from a number of sources.

Component C — a mixture, the essential components of which are:

(1) about 60 to 80 percent by weight of mineral oil having a viscosity of between about 50 and 150 SUS at 100° F;

(2) about 25 to 10 percent by weight of an aliphatic monohydric alcohol having 10 to 18 carbons, which has been ethoxylated with about 2 to 4 moles of ethylene oxide; and (3) about 15 to 10 percent by weight of the neutralized reaction product of (a) about 3 moles of an aliphatic monohydric alcohol having from 8 to 14 carbons, which has been ethoxylated with about 2 to 9 moles of ethylene oxide, and (b) about 1 mole of $P_2O_5$.

Herein, component (1), the mineral oil, is advantageously any readily-available refined hydrocarbon oil (e.g., petrolatum liquid), the viscosity of which is between about 50 and 100 SUS at 100° F. Moreover, the very best results are achieved when component (2) of this mixture is prepared from an aliphatic monohydric alcohol having from 12 to 15 carbons, and when such alcohol has been ethoxylated with between 3 and 4 moles of ethylene oxide. Such compounds, which are readily available commercially, are prepared by standard techniques of synthetic organic chemistry, well known to those of skill in this art. Component (3) of this mixture, the neutralized partial ester of phosphoric acid and an ethoxylated aliphatic monohydric alcohol, is prepared by standard synthetic methods of organic chemistry by reacting the chosen aliphatic monohydric alcohol with the desired amount of ethylene oxide; esterifying the resulting ethoxylated alcohol with the appropriate amount of $P_2O_5$; and neutralizing the resulting ester. The very best results are obtained when the aliphatic monohydric alcohol has from 10–14 carbons, about 4 to 6 moles of ethylene oxide are used to ethoxylate each mole of the aliphatic monohydric alcohol, and the resulting ester is brought to neutrality with an amine such as morpholine or monoethanolamine. Such compounds are available from commercial sources.

The finish components are admixed to effect a homogeneous blend — or an emulsion, especially an aqueous emulsion. The blend — or the organic portion of the emulsion — has the following required composition;

Component (C) — between about 5 and 70 percent by weight; and

Composite of Components (A) and (B) — between about 95 and 30 percent by weight, with the weight ratio of Component (A) to Component (B) in the Composite being between about 5/95 and 60/40. Details concerning the preparation of a suitable aqueous emulsion are found in Example 1 hereinbelow. The homogeneous blend, or the aqueous or organic emulsion or solution thereof, is applied to the acrylic fibers as specified hereinabove in an amount sufficient to provide a finish-on-fiber content of between about 0.2 and 1.4 percent by weight. Under these conditions, an acrylic fiber is produced which has frictional and electrostatic properties — as defined immediately below and tabulated hereinafter in Table 1 — which indicate its acceptability for satisfactory fiber processing under a wide range of conditions. Moreover, under these conditions, an acrylic fiber is produced, the further processing and handling of which does not result in (a) heavy dust and card fallout; (b) substantial deposits on rolls and metal parts of drawing, roving, and spinning equipment; and (C) non-uniformity in the drawing of sliver, as evidenced by the presence of thick and thin regions therein, which are subsequently found in yarn spun therefrom. Data to support such conclusions are found tabulated hereinafter in Table II. It should be emphasized that finish-on-fiber contents of less than about 0.2 do not result in the desirable properties and effects referred to above. Moreover, there is no technological advantage in employing finish-to-fiber contents of greater than about 1.4 — indeed, such may, in fact, be deleterious under certain conditions.

Properties and effects referred to in examples and tables set forth hereinafter are understood by those of skill in the art as follows:

Coefficient of Friction — that measured on a continuous filament yarn traveling at 100 meters per minute, using an RMS-4 stainless steel pin and a contact angle of 180°, with the aid of a standard, commercially-available Rothschild F-Meter. Coefficient of friction values of 0.45 - 0.50 and greater signify potential processing difficulties, indicating that a lower inherent lubricity region has been entered.

Static — static buildup in volts, as measured after 2 minutes by means of a Rothschild Static Meter on continuous filament yarn traveling at 100 meters per minute. Static values of 500 volts and greater point to a buildup of static in carding which would render such a process completely inoperable.

Fiber-to-Fiber Tension (stick/slip) — As measured on a standard Rothschild F-Meter, the fiber-to-fiber output tension at 50 grams pretension and 1800° contact (5 wraps). These values point to what can be expected in drawing and roving. Desired is a low base figure (the second figure given), and a substantial spread at very low speeds, which indicates the capacity for a coherent drafting pattern.

Carding "Fly (airborne)" and "Pulverized Fallout", "Coefficient of Variation" and "Number of Imperfections" (as measured on a standard Uster Evenness Instrument), and "Roll Deposits" are all well-understood by those of skill in the art and require no further explication here.

The present invention, especially its primary and related objects and multiple benefits, may be better understood by referring to the following examples, which are set forth for illustrative purposes only.

EXAMPLE 1

A. 75 pounds of polyethylene glycol-6600 mono (dinonyl phenyl) ether and 19.5 pounds of diethanolamine were dissolved in 1016 pounds of water, and the solution was heated to 90° - 98° C. While this solution was being agitated, 75 pounds of the reaction product of hydrogenated tallow alcohol and $P_2O_5$ at a weight ratio of 3/1 were dispersed therein. After further agitation at 90° - 98° C for about 20 minutes, the batch was cooled to 40° C, and 170 pounds of a mixture of the following components was then added thereto under continued agitation within a 15 to 20 minute period: 119 pounds of white mineral oil having a viscosity of 50 - 75 SUS at 100° F; 27 pounds of the reaction product of one mole of a mixture of $C_{12}$ - $C_{15}$ aliphatic monohydric alcohols and 3 - 4 moles of ethylene oxide; and 24 pounds of the phosphated reaction product of isodecyl alcohol and 5 - 6 moles of ethylene oxide (at a 3/1 ratio of ethoxylated alcohol to $P_2O_5$) which had been brought to neutrality with morpholine. The batch was stirred for an additional 20 minutes.

Polyacrylonitrile fiber tow having a single fiber denier of 3 was continuously impregnated (after stretching, drying and re-wetting thereof) with a diluted emulsion of 1 part of the above composition and 4 parts of water at such a rate of application that 0.7 percent of finish solids were retained on the tow. The tow was heated in a steam box, crimped, and dried in hot air. It was then cut into 2-inch staple.

This staple was then processed on the cotton system through carding, drawing, roving, and spinning, revealing excellent processability with minimal waste generation, uniform sliver drawing and spinning, and no deposits on processing equipment. B. By way of comparison, a similar finish was prepared following the procedure outlined in A above, except that the mineral oil composite was not employed. In the processing of fiber treated with such finish, excessive dust and card fallout was experienced, undesirable deposits on rolls and metal parts of drawing and roving equipment were found, and non-uniformity in the drawing of the sliver was observed, as evidenced by the presence of thick and thin places therein.

EXAMPLE 2

In each of a series of individual runs, a finish composition was prepared according to a procedure similar to that employed in Example 1 above. Components A, B, and C as identified below were employed in preparing the individual finish compositions. The percent by weight of each component employed in each individual finish composition is found in Table I below.

Component A — dinonyl phenol ethoxylated with 150 moles of ethylene oxide;

Component B — the diethanolamine - neutralized partial ester of phosphoric acid and hydrogenated tallow alcohol;

Component C — a mixture consisting of:

(1) 70 percent by weight of a white mineral oil having a viscosity of 50 SUS at 100° F;

(2) 16 percent of a mixture of $C_{12}$ - $C_{15}$ aliphatic monohydric alcohols which has been ethoxylated with 3.5 moles of ethylene oxide per mole of alcohol; and (3) 14 percent of a morpholine — neutralized phosphated reaction product of isodecyl alcohol and 5 moles of ethylene oxide (at a 3/1 ratio of ethoxylated alcohol to $P_2O_5$).

Sections of continuous filament polyacrylonitrile yarn of 200 total denier were individually impregnated with an aqueous emulsion of a separate finish, the preparation of which was otherwise identical to that specified in Example 1 above. Each diluted aqueous finish emulsion was applied to an individual section of yarn at a rate which provided the retained finish solids as shown in Table I. Each treated yarn section was then dried on a heated metal cylinder and conditioned for 24 hours at 72° F and 35 percent relative humidity.

Coefficient of friction, static, and fiber-to-fiber tension measurements were then made on each section of treated yarn, the results of which measurements are tabulated in Table I.

TABLE I.

| Run No. | | Retained Finish Solids, % | Finish Composition % A | % B | % C | COF[1] | Static[2] Volts | F/F Tension (Stick/Slip), Grams[3] 2 | 5 | 50 | 100mm/min. |
|---|---|---|---|---|---|---|---|---|---|---|---|
| 1 | (This Invention) | 0.75% | 33 | 42 | 25 | .40 | 50 | 130/90 | 145/90 | 150/106 | 148/112 |
| 2 | ( " ) | 0.75% | 29 | 37 | 34 | .35 | 60 | 136/85 | 136/85 | 148/102 | 148/105 |
| 3 | ( " ) | 0.75% | 22 | 28 | 50 | .36 | 50 | 142/100 | 135/100 | 154/115 | 150/118 |
| 4 | ( " ) | 0.75% | 15 | 19 | 66 | .33 | 250 | 155/100 | 145/95 | 158/112 | 125 |
| 5 | (For Comparison) | 0.75% | 11 | 14 | 75 | .35 | 750 | 138/102 | 134/100 | 170/125 | 135 |
| 6 | (This Invention) | 0.75% | 40 | 52 | 8 | .38 | 150 | 125/88 | 115/85 | 105/85 | 110/90 |
| 7 | ( " ) | 0.35% | 5.5 | 44.5 | 50 | .38 | 20 | 144/102 | 134/102 | 156/125 | 150/120 |

TABLE I.-continued

| Run No. | | Retained Finish Solids, % | Finish Composition % A | % B | % C | COF[1] | Static[2] Volts | F/F Tension (Stick/Slip), Grams[3] 2 | 5 | 50 | 100mm/min. |
|---|---|---|---|---|---|---|---|---|---|---|---|
| 8 | ( " ) | 0.35% | 12 | 38 | 50 | .36 | 20 | 146/104 | 140/102 | 162/122 | 150/126 |
| 9 | ( " ) | 0.35% | 22 | 28 | 50 | .34 | 250 | 142/100 | 135/100 | 154/115 | 150/118 |
| 10 | ( " ) | 0.35% | 28 | 22 | 50 | .35 | 100 | 182/98 | 165/100 | 156/92 | 136/112 |
| 11 | (For Comparison) | 0.35% | 31 | 19 | 50 | .35 | 700 | 150/94 | 126/95 | 155/97 | 150/110 |
| 12 | ( " ) | 0.35% | 43.5 | 6.5 | 50 | .35 | 1000 | — | — | — | — |

[1]Coefficient of friction measured on continuous filament yarn at 100m/min. using an RMS-4 stainless steel pin and a contact angle of 180°
[2]Static buildup in 2 minutes at 100m/min.
[3]Fiber-to-fiber output tension at 50g pretension and 1800° contact (5 wraps)

EXAMPLE 3

Run A (This Invention):

An acrylic fiber tow was impregnated with an aqueous emulsion of a finish composition consisting of 22% A, 28% B, and 50% C, as described in more detail hereinabove in Example 2. It was then crimped and dried. The amount of finish on the fiber was 0.7%. The tow was cut into 2-inch staple and processed on the cotton system through carding, drawing (twice), roving, and spinning. Fly (airborne) front and rear, pulverized fallout, and coefficient of variation (Uster) were determined in the carding operation. The presence or absence of roll deposits in the drawing operation was also determined, and coefficient of variation (Uster) and the number of imperfections in the final spun yarn product were established. The results of these determinations are found in Table II.

Run B (Not this Invention — For Comparison):

In a run similar to that of Run A above, an identical procedure was followed except that the finish consisted of 44% A and 56% B. The amount of finish on the fiber was 0.6 percent. The results of determinations identical to those made in Run A are also summarized in Table II.

TABLE II.

| | Run A | Run B |
|---|---|---|
| 1. Carding: | | |
| % (Fly) (airborne), front | .016 | .051 |
| % (Fly) (airborne), rear | .083 | .106 |
| % Pulverized fallout | .007 | .010 |
| Coefficient of Variation (Uster), on sliver, % | 3.4 | 4.0 |
| 2. Drawing: | | |
| Roll deposits | no | yes |
| 3. Final Spun Yarn: | | |
| % Coefficient of Variation (Uster) | 17.6 | 18.8 |
| Number of Imperfections in 500 yards (Uster): | | |
| Thin places (Setting 40) | 171 | 244 |
| Thick places (Setting 4) | 113 | 179 |

TABLE II.-continued

| | Run A | Run B |
|---|---|---|
| Neps (Setting 4) | 7 | 21 |

EXAMPLE 4

In each of a series of individual runs, a finish composition was prepared according to a procedure similar to those employed in Examples 1 and 2 above. The individual finish compositions contained the following components in the percentages indicated:

22% Component A — dinonyl phenol ethoxylated with 150 moles of ethylene oxide;

28% Component B — the diethanolamine — neutralized partial ester of phosphoric acid and hydrogenated tallow alcohol;

50% Component C — a mixture consisting of:

(1) 70% of white mineral oil having a viscosity of 50 SUS at 100° F;

(2) 16% of an oleophilic emulsifier as identified in Table III below; and (3) 14% of a hydrophilic emulsifier as identified in Table III below. Sections of continuous filament polyacrylonitrile yarn of 200 denier were individually impregnated with an aqueous emulsion of a separate finish, the preparation of which was otherwise identical to that specified in Example 1 above. Each diluted aqueous finish emulsion was applied to an individual section of yarn at a rate which provided a retained finish solids of 0.75%. Each treated yarn section was then dried on a heated metal cylinder and conditioned for 24 hours at 72° F and 35% relative humidity. Coefficient of friction, static, and fiber-to-fiber tension measurements were then made on each section of treated yarn, the results of which are tabulated in Table III.

TABLE III.

| | Run No. | Oleophilic Emulsifier | Hydrophilic Emulsifier | COF[1] | Stat, V[2] | F/F Tension[3] (Stick/Slip) 50 | 100 mm/min. |
|---|---|---|---|---|---|---|---|
| 1. | (This Invention) | Lauryl alcohol + 2 ethylene oxide (EO) | $C_{10}$ alcohol + 6 EO phosph. morpholine salt | .35 | 25 | 160/118 | 125 |
| 2. | ( " ) | $C_{13}$ alcohol + 3.8 EO | $C_{13}$ alcohol + 6 EO phosph. monoethanolamine salt | .38 | 0 | 188/138 | 185/138 |
| 3. | ( " ) | $C_{10}$–$C_{14}$ alcohol + 3 EO | $C_{10}$ alcohol – 6 EO phosph. morpholine salt | .37 | 0 | 138/102 | 132/105 |
| 4. | ( " ) | $C_{12}$–$C_{14}$ alcohol + 4 EO | $C_{12}$–$C_{14}$ alcohol + 4 EO phosph. morpholine salt | .39 | 10 | 150/105 | 140/115 |
| 5. | ( " ) | $C_{12}$–$C_{18}$ alcohol[4] + 3.5 EO | $C_{10}$ alcohol + 6 EO phosph. morpholine salt | .35 | — | 156/110 | 150/115 |

[1]Coefficient of friction measured on continuous filament yarn at 57m/min. (Run No. 5 at 100m/min.) using RMS-4 stainless steel pin and contact angle of 180°
[2]Static buildup in one minute
[3]Fiber-to-fiber output tension at 50g pretension and 1800° contact (5 wraps)
[4]40% $C_{12}$, 30% $C_{14}$, 20% $C_{16}$, 20% $C_{18}$

EXAMPLE 5

A procedure identical to that in Example 1 above was followed, except that the acrylic polymer was a terpolymer having the following composition: 91% acrylonitrile; 8% methyl acrylate; and 1% 2-sulfoethyl methacrylate. A finish identical to that of Example 1 was prepared and applied to the acrylic terpolymer tow, and 0.5 percent solids were retained. The tow was heated in a steam box, crimped, and dried in hot air. It was then cut into 2-inch staple.

This staple was then processed on the cotton system through carding, drawing, roving, and spinning, revealing excellent processability with minimal waste generation, uniform sliver drawing and spinning, and no deposits on processing equipment.

Although the present invention has been described in detail with respect to certain preferred embodiments thereof, it is apparent to those of skill in the art that variations in this detail may be effected without any departure from the spirit and scope of the present invention as defined in the hereto-appended claims.

What is claimed is:

1. A finish for acrylic fiber consisting essentially of:
(A) an alkyl phenol which has been ethoxylated with from about 40 to about 200 moles of ethylene oxide;
(B) the neutralized reaction product of
(1) about 3 moles of an aliphatic monohydric alcohol having from 14 to 22 carbons, and
(2) about 1 mole of $P_2O_5$; and
(C) a mixture consisting essentially of
(1) about 60 to 80 percent by weight of mineral oil having a viscosity of between about 50 and 150 Saybolt Universal Seconds at 100° F;
(2) about 25 to 10 percent by weight of an aliphatic monohydric alcohol having 10 to 18 carbons, which has been ethoxylated with about 2 to 4 moles of ethylene oxide; and
(3) about 15 to 10 percent by weight of the neutralized reaction product of
(a) about 3 moles of an aliphatic monohydric alcohol having from 8 to 14 carbons, which has been ethoxylated with about 2 to 9 moles of ethylene oxide, and
(b) about 1 mole of $P_2O_5$;
wherein the amount of component (C) is between about 5 and 70 percent by weight of the composition with the remainder thereof being a composite of components (A) and (B) in a weight ratio of component (A) to component (B) of between about 5/95 and 60/40.

2. The finish of claim 1, wherein component (A) is a dialkyl phenol ethoxylated with between 125 and 175 moles of ethylene oxide.

3. The finish of claim 1, wherein component (B) is an amine salt of hydrogenated tallow alcohol phosphate.

4. The finish of claim 1, wherein component (C) consists essentially of
(1) a mineral oil having a viscosity of about 50 – 100 SUS at 100° F;
(2) an aliphatic monohydric alcohol having from 12 to 15 carbons, which has been ethoxylated with between 3 and 4 moles of ethylene oxide; and
(3) the amine-neutralized reaction product of
(a) about 3 moles of an aliphatic monohydric alcohol having from 10 – 14 carbons, which has been ethoxylated with about 4 to 6 moles of ethylene oxide, and
(b) about 1 mole of $P_2O_5$.

5. Acrylic fiber having incorporated thereon from about 0.2 to about 1.4 percent by weight of a finish consisting essentially of:
(A) an alkyl phenol which has been ethoxylated with from about 40 to about 200 moles of ethylene oxide;
(B) the neutralized reaction product of
(1) about 3 moles of an aliphatic monohydric alcohol having from 14 to 22 carbons, and
(2) about 1 mole of $P_2O_5$; and
(C) a mixture consisting essentially of
(1) about 60 to 80 percent by weight of mineral oil having a viscosity of between about 50 and 150 SUS at 100° F;
(2) about 25 to 10 percent by weight of an aliphatic monohydric alcohol having 10 to 18 carbons, which has been ethoxylated with about 2 to 4 moles of ethylene oxide; and
(3) about 15 to 10 percent by weight of the neutralized reaction product of
(a) about 3 moles of an aliphatic monohydric alcohol having from 8 to 14 carbons, which has been ethoxylated with about 2 to 9 moles of ethylene oxide, and
(b) about 1 mole of $P_2O_5$;
wherein the amount of component (C) is between about 5 and 70 percent by weight of the composition with the remainder thereof being a composite of components (A) and (B) in a weight ratio of component (A) to component (B) of between about 5/95 and 60/40.

6. The acrylic fiber of claim 5, wherein component (A) of the finish is a dialkyl phenol ethoxylated with between 125 and 175 moles of ethylene oxide.

7. The acrylic fiber of claim 5, wherein component (B) of the finish is an amine salt of hydrogenated tallow alcohol phosphate.

8. The acrylic fiber of claim 5, wherein component (C) of the finish consists essentially of
(1) a mineral oil having a viscosity of about 50 – 100 SUS at 100° F;
(2) an aliphatic monohydric alcohol having from 12 to 15 carbons, which has been ethoxylated with between 3 and 4 moles of ethylene oxide; and
(3) the amine-neutralized reaction product of
(a) about 3 moles of an aliphatic monohydric alcohol having from 10 – 14 carbons, which has been ethoxylated with about 4 to 6 moles of ethylene oxide, and
(b) about 1 mole of $P_2O_5$.

* * * * *